US007819612B2

(12) United States Patent
Huang

(10) Patent No.: US 7,819,612 B2
(45) Date of Patent: Oct. 26, 2010

(54) PARKING DEVICE

(76) Inventor: Kuo-Shuen Huang, 4F, No. 153, Nung-An Street, Taipei City (TW)

( * ) Notice: Subject to any disclaimer, the term of this patent is extended or adjusted under 35 U.S.C. 154(b) by 630 days.

(21) Appl. No.: 11/662,778

(22) PCT Filed: Oct. 8, 2005

(86) PCT No.: PCT/CN2005/006139

§ 371 (c)(1),
(2), (4) Date: Mar. 14, 2007

(87) PCT Pub. No.: WO2006/037275

PCT Pub. Date: Apr. 13, 2006

(65) Prior Publication Data

US 2009/0049759 A1 Feb. 26, 2009

(30) Foreign Application Priority Data

Oct. 7, 2004 (JP) ..... 2004-294558

(51) Int. Cl.
*B60P 3/07* (2006.01)
*E04H 6/06* (2006.01)

(52) U.S. Cl. ..... 410/4

(58) Field of Classification Search ..... 410/4, 410/7, 8, 24, 26, 46; 414/234, 239–241, 414/243–246, 254, 260, 264, 272
See application file for complete search history.

(56) References Cited

U.S. PATENT DOCUMENTS

| | | | | |
|---|---|---|---|---|
| 2,752,051 | A * | 6/1956 | Strahm et al. | 414/254 |
| 3,680,718 | A * | 8/1972 | Miyachi | 414/239 |
| 6,345,948 | B1 * | 2/2002 | Irish | 414/234 |
| 2006/0018738 | A1 * | 1/2006 | Yen | 414/234 |
| 2006/0182546 | A1 * | 8/2006 | Shinozuka | 414/234 |

FOREIGN PATENT DOCUMENTS

JP 05106364 A * 4/1993

* cited by examiner

*Primary Examiner*—H Gutman
(74) *Attorney, Agent, or Firm*—Leong C. Lei

(57) ABSTRACT

A parking device comprises a trolley, two guide rails located on the trolley, shanks on each of the guide rails and a drive unit located on the trolley, in which, numbers of round transmission bodies are arranged adjacently and alternately between the inner side of the shanks, the transmission bodies are strung as an array and each of the arrays coupled with the shanks by a shaft respectively, furthermore, whether the odd arrays or the even arrays of the transmission bodies are strung and coupled with the shanks. As a result, the clearance resulting from the sedate array is filled up by the alternated spaced array of the transmission bodies, while the two opposite sides of the transmission bodies from the forked butt joint in the ends. Therefore, the parking device stabilizes the transmission of the car and shortens the transmission time.

4 Claims, 12 Drawing Sheets

PARKING DEVICE

BACKGROUND OF THE INVENTION

1. Field of the Invention

The present invention generally relates to a parking device, and more particularly to parking device comprising a plurality of transmission bodies for transporting a car capable of minimizing shake to the parked car during transporting and also reduce the parking/transportation time.

2. Description of Related Art

With the increasing number of cars, the parking space available is often insufficient, especially in the metropolis. Due to the limitation of ground parking spaces, some manufacturers invented mechanical parking device and warehouse type parking device. The aforementioned parking device is capable of providing much parking spaces by stacking the cars, however these parking devices use the flat to shifting the cars to the available spaces. The Taiwan Patent Publication No. 269716 on Feb. 1, 1996 is a conventional parking tower having a plurality of parking layers with horizontally positioned track. A transporting deck and a plurality of parking zones are set on the track. The parking tower is jointed with a parking entrance/exit, which equipped with an elevator. When a car enters into the parking entrance/exit, the transporting deck on the elevator transports the car to the track, and then the track transports the car to the parking zone. Likewise, the car on the transportation deck in the parking zone can be shift to the track, and then the car is shifted to the elevator for transporting the car out of the parking entrance/exit.

However, the above-described conventional parking device has the following disadvantages.

1. During transporting, the car on the transporting deck along the track may shank and this may easily cause damage to the car.

2. In order to transport the car into transportation deck, the driver has to drive the car onto the elevator, and transportation of the car in or out of the parking entrance/exit takes additional time.

The Taiwan Patent Publication No. 372255 on Oct. 21, 1999 is another conventional parking device comprising a car warehouse including a channel for allowing a car to pass. The automobile warehouse comprises a plurality of elevating rooms and each elevating room has a cell. Supporting elements are disposed in the cells of the elevating room, wherein the supporting element is motivated by a lift. When a car enters into the automobile warehouse via the channel, the car is transported to the elevating room and the lift motivates the supporting element to transport the car to the cell on a layer to position the supporting element and the car on a parking rack in the cell. Furthermore, the supporting element descends to a position between the parking racks. Thus, the car can be positioned on the parking rack in the cell.

However, the above-mentioned parking device still has the following defects.

1. The supporting element comprises a plurality of bars with larger gaps there-between. When a car is positioned on the supporting element, the swinging or shake may damage the components in the car.

2. When the driver gets the car in/out of the cell, the supporting element must be accurately position to the parking rack in the cell, otherwise the supporting element can easily go beyond the range of the parking rack and may jam the parking device. Jamming of the parking device may further cause damage to the supporting element and the parking rack.

Furthermore, referring to the Taiwan Patent Publication No. 248841 (the Taiwan Patent Application No. 82209754), a double-layer warehouse parking device comprises a parking rack, and the parking rack comprises a first transporter and a second transporter, wherein the first transporter is adopted for shifting the upper parking deck positioned on upper the parking rack and the second transporter is adopted for shifting the lower parking deck positioned on the lower parking rack. During the transportation, only one of the first transporter and the second transporter can be selected, and therefore the operation time is accordingly long. Besides, when a car is positioned on the upper or the lower parking deck, the parking deck also shakes.

Accordingly, it is highly desirable to improve the parking device.

SUMMARY OF THE INVENTION

According to an aspect of the present invention, the parking device, suitable for minimizing shake to a parked car during transporting, comprises two guide rails secured on a trolley, and a shank is respectively disposed on each guide rail. A plurality of transmission bodies are arranged adjacently and alternately between inner sides of the shanks and coupled with the shanks by shafts.

The shanks of the trolley comprise a drive unit, and the transmission bodies are coupled between the inner sides of the shanks by the shafts.

The drive unit can be set on the trolley.

The transmission bodies are arranged adjacently and alternately between the inner sides of the shanks to fill a gap, and forked butt joints are formed at two opposite sides of the transmission bodies in two ends.

The transmission bodies are strung as a plurality of arrays, and each of the odd arrays and the even arrays is coupled with the shanks.

The transmission bodies can be round wheels or round poles.

According to another aspect of the present invention, the parking device, suitable for minimizing shake to a parked car during transporting, comprises two guide rails secured on a trolley, a shank is respectively disposed on each guide rail and a drive unit. A plurality of transmission bodies are arranged adjacently and alternately between inner sides of the shanks and strung as a plurality of arrays. The transmission bodies comprise a plurality of shafts to couple the arrays to the shanks, and forked butt joints are formed at two opposite sides of the transmission bodies in two ends. The forked butt joints of the transmission bodies on one trolley can buckled to the forked butt joints of the transmission bodies on another trolley. Thus, the parking device can be capable of minimizing shake to the parked car during transporting and also reduce the parking/transportation time.

The transmission bodies are strung as a plurality of arrays, and each of the odd arrays and the even arrays is coupled with the shanks.

The present invention has at least the following advantages.

1. The trolley comprises the alternate arrays of the transmission bodies to provide more stably transport.

2. The transportation deck can set the position to the space of the parking tower, and by buckling the forked butt joints of the transmission bodies, a gap between the transportation deck and the space may be minimized to avoid undesirably shaking the car.

3. The transmission bodies can transport the car stably, thus damage to the components caused during the quake may be effectively reduced.

4. The transmission bodies of the trolley can be driven by the drive unit to automatically transport the car to effectively reduce the operation time.

DETAILED DESCRIPTION OF PREFERRED EMBODIMENTS

Figure 1:
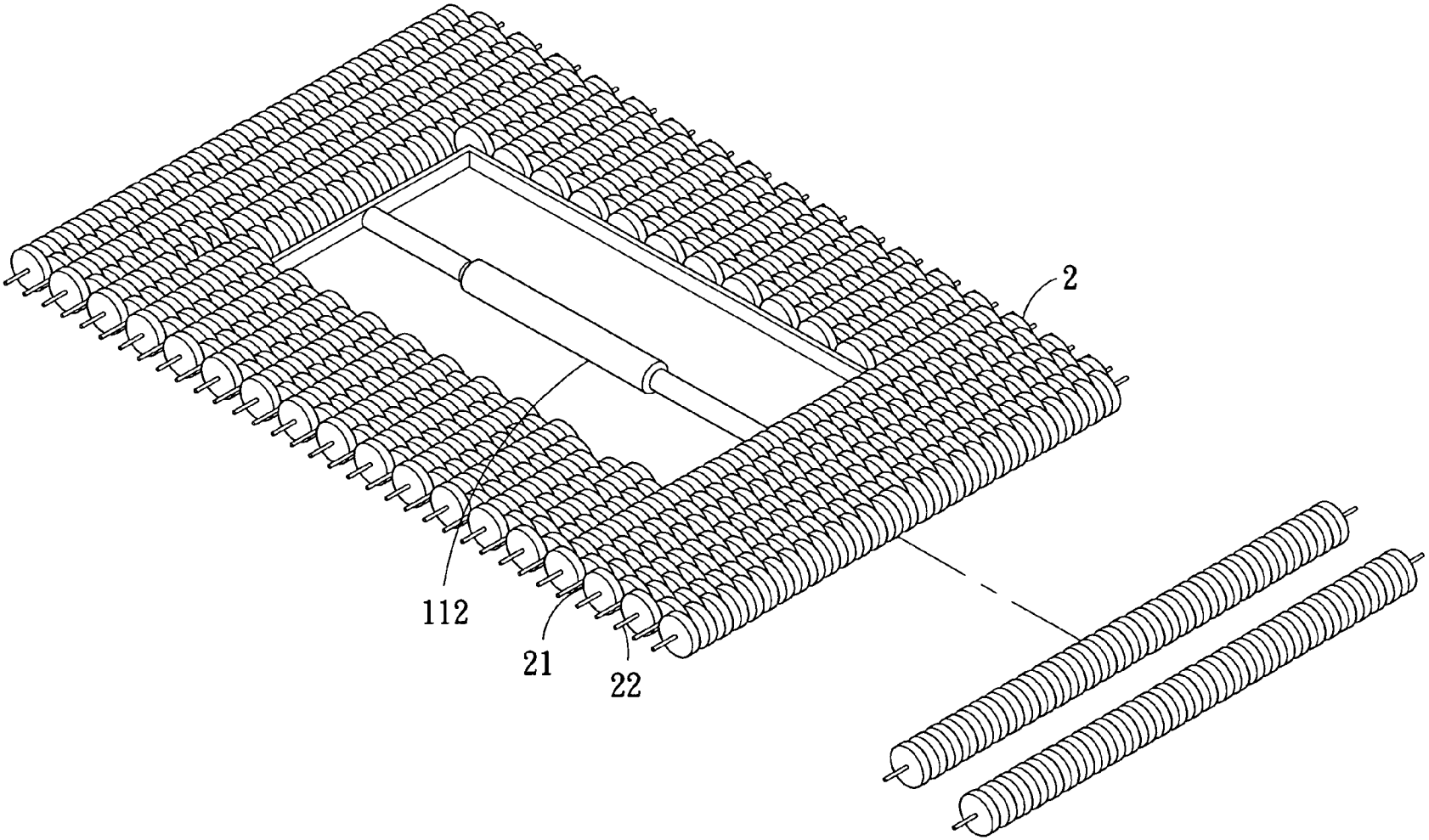
FIG. 1 is an elevational view of the transmission bodies according to an embodiment of the present invention.
Figure 2:
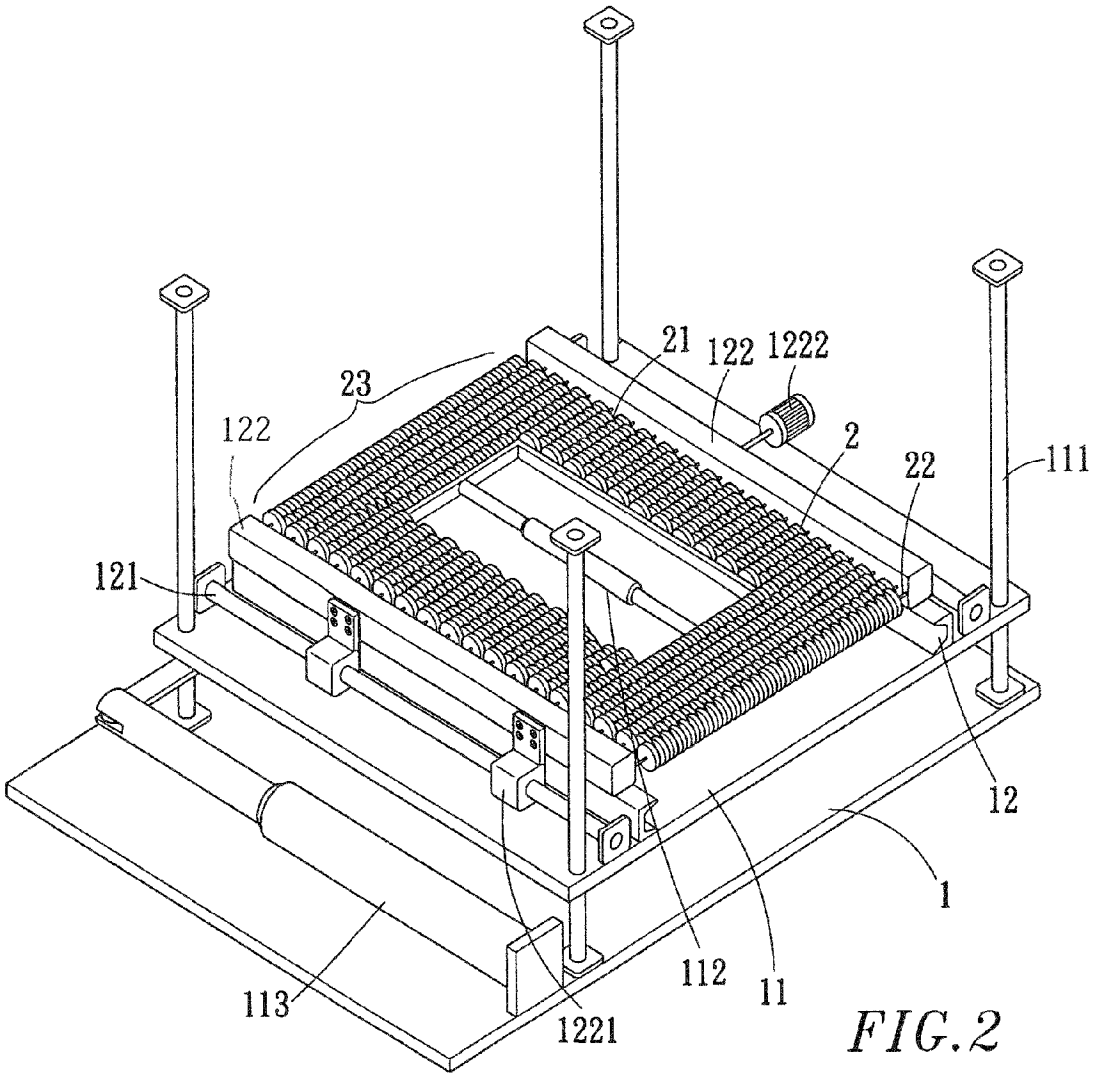
FIG. 2 is an elevational view of the parking device according to an embodiment of the present invention.
Figure 3:
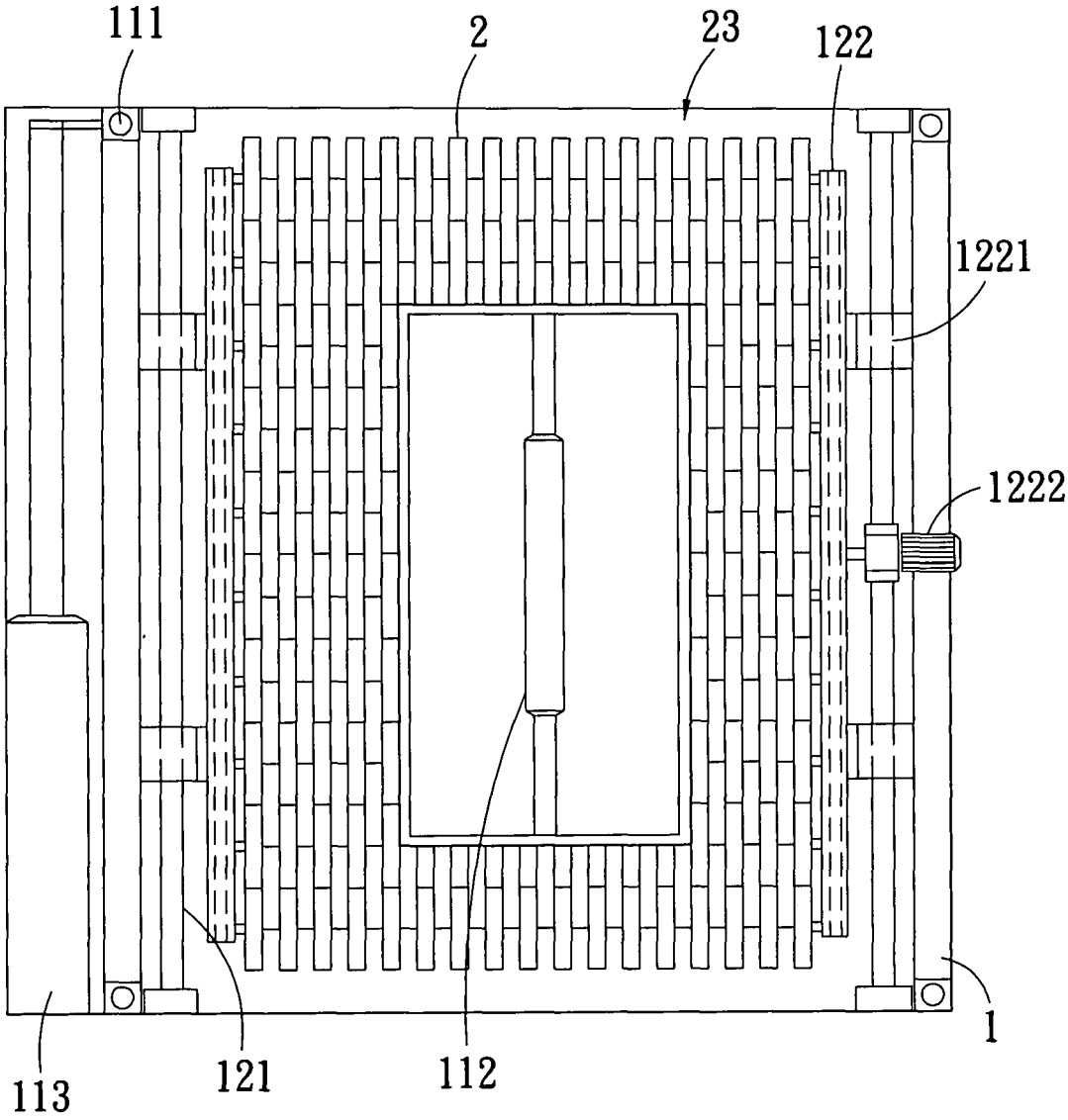
FIG. 3 is a top view shown in FIG. 2.

Referring to FIGS. 1, 2, 3 and 4, a parking device of the present invention comprises a trolley 1 and a plurality of transmission bodies 2.

The trolley 1 comprises four vertical axles 111 on four corners, and a lift 11 is positioned horizontally on the vertical axles 111. A pushing liquid pressure tank 112 is positioned on the lift 11. The lift 11 is driven by a lifting liquid pressure tank 113 to move the lift 11 up or down along the vertical axles 111. The lift 11 comprises two guide rails 12 on the two sides and two horizontal axles 121 each positioned on the outer side of the guide rail 12. Furthermore, each of the guide rails 12 comprises a shank 122 for moving along a horizontal direction, and a plurality of the slide axles 1221 are concentrically surrounding the horizontal axles 121 at the outer side of the shanks 122. The shanks 122 are driven by a drive unit 1222 and jointed to the pushing liquid pressure tank 112 of the lift 11.

The transmission bodies 2 are arranged adjacently and alternately between the inner sides of the shanks 122 to fill a gaps 21. The transmission bodies 2 are strung as a plurality of arrays, and each of the odd arrays and the even arrays is coupled with the shanks 122 by a shaft 22 respectively. Besides, the two opposite sides of the transmission bodies 2 form forked butt joints 23 in the ends. The transmission bodies 2 can be round wheels or round poles.

The transmission bodies 2 are arranged between the inners side of the two shanks 122 of the lift 11 by the shafts 22, and the drive unit 1222 drives the shanks 122 and the shafts 22 to rotate the transmission bodies 2. Further, the transmission bodies 2 are connected to the pushing liquid pressure tank 112 of the lift 11. The pushing liquid pressure tank 112 is adopted for pushing the shanks 122 and the transmission bodies 2, and the shanks 122 can slide along with the slide axles 1221 on the horizontal axles 121. Thus, the shanks 122 and the transmission bodies 2 can move horizontally on the trolley 1.

The guide rails 12 of the trolley 1 are positioned parallel and each of the guide rails 2 has a shank 122. The shank 122 can be a gear, a belt or a motoring device with driving capability. Further, the shank 122 is connected to a drive unit 1222 for driving. The drive unit 1222 can be set on the trolley 1 or at the outer side of the trolley 1. Thus, the drive unit 1222 can drive the shank 122.

The trolley 1 further comprises a transportation motor 13 and a plurality of rollers 131. The transportation motor 13 can motivate the rollers 131 to roll on a track 132 to move the trolley 1.

Figure 4:
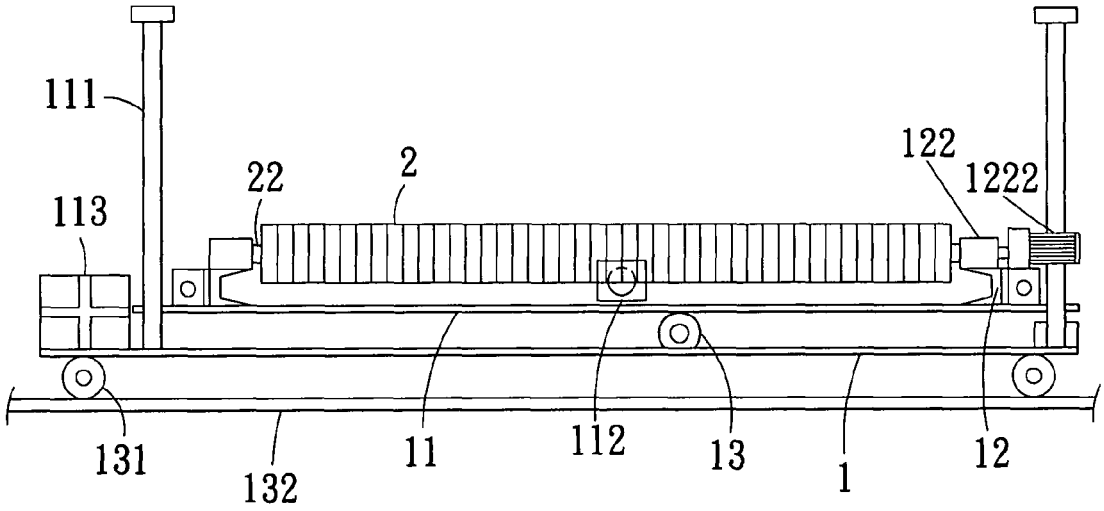
FIG. 4 is a side view shown in FIG. 2.
Figure 5:
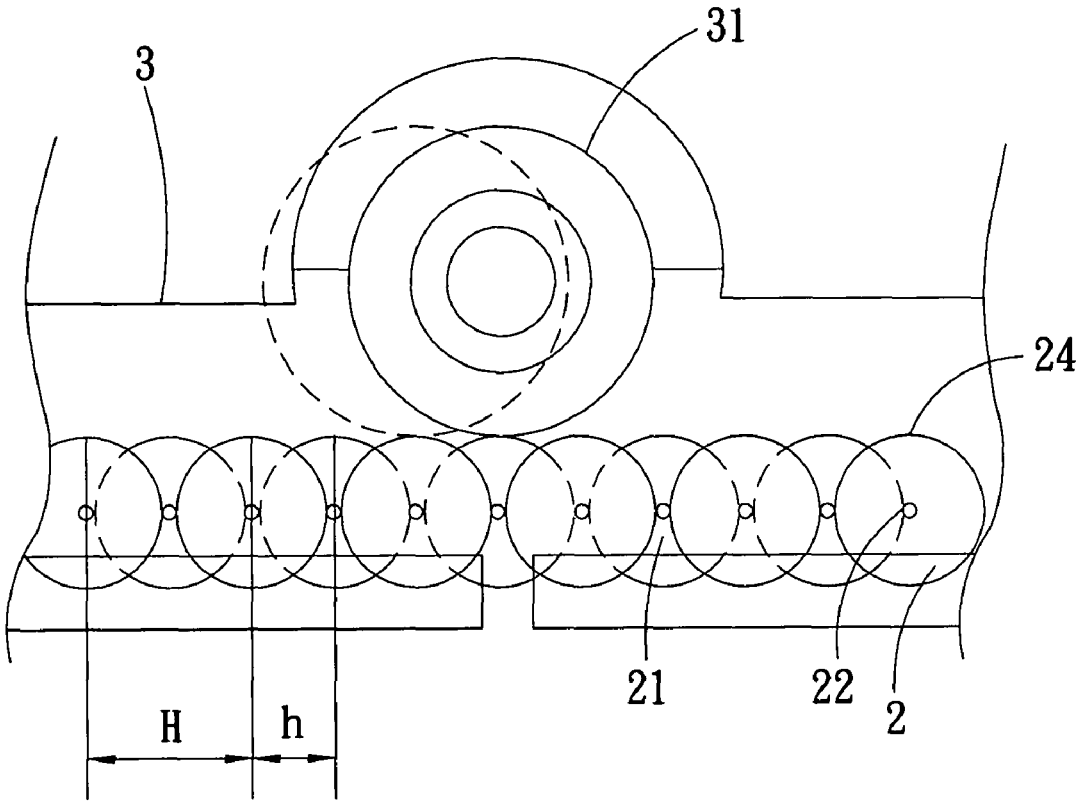
FIG. 5 is a sectional side view of the transmission bodies according to an embodiment of the present invention.
Figure 6:
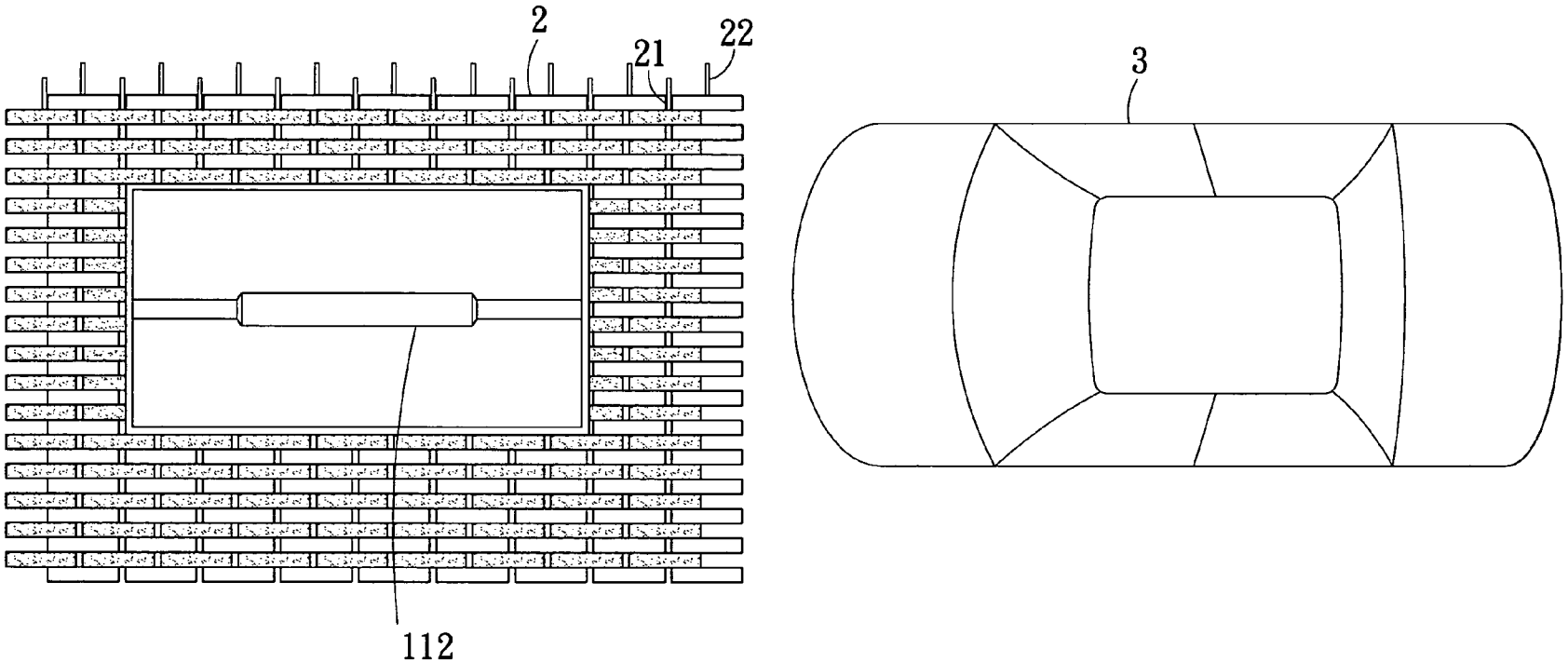
FIG. 6 is a top view for illustrating operation of the parking device according to an embodiment of the present invention.

Referring to FIGS. 4, 5 and 6, because the transmission bodies 2 are arranged adjacently and alternately, a tangent distance between top portions 24 of the adjacent transmission bodies 2 is shorten from H to h. Thus, when a car 3 is driven on the transmission bodies 2, the height difference between the adjacent transmission bodies 2 is small and will not shake the car 3, and wheels 31 of the car 3 can be more stable thereon.

Figure 7:
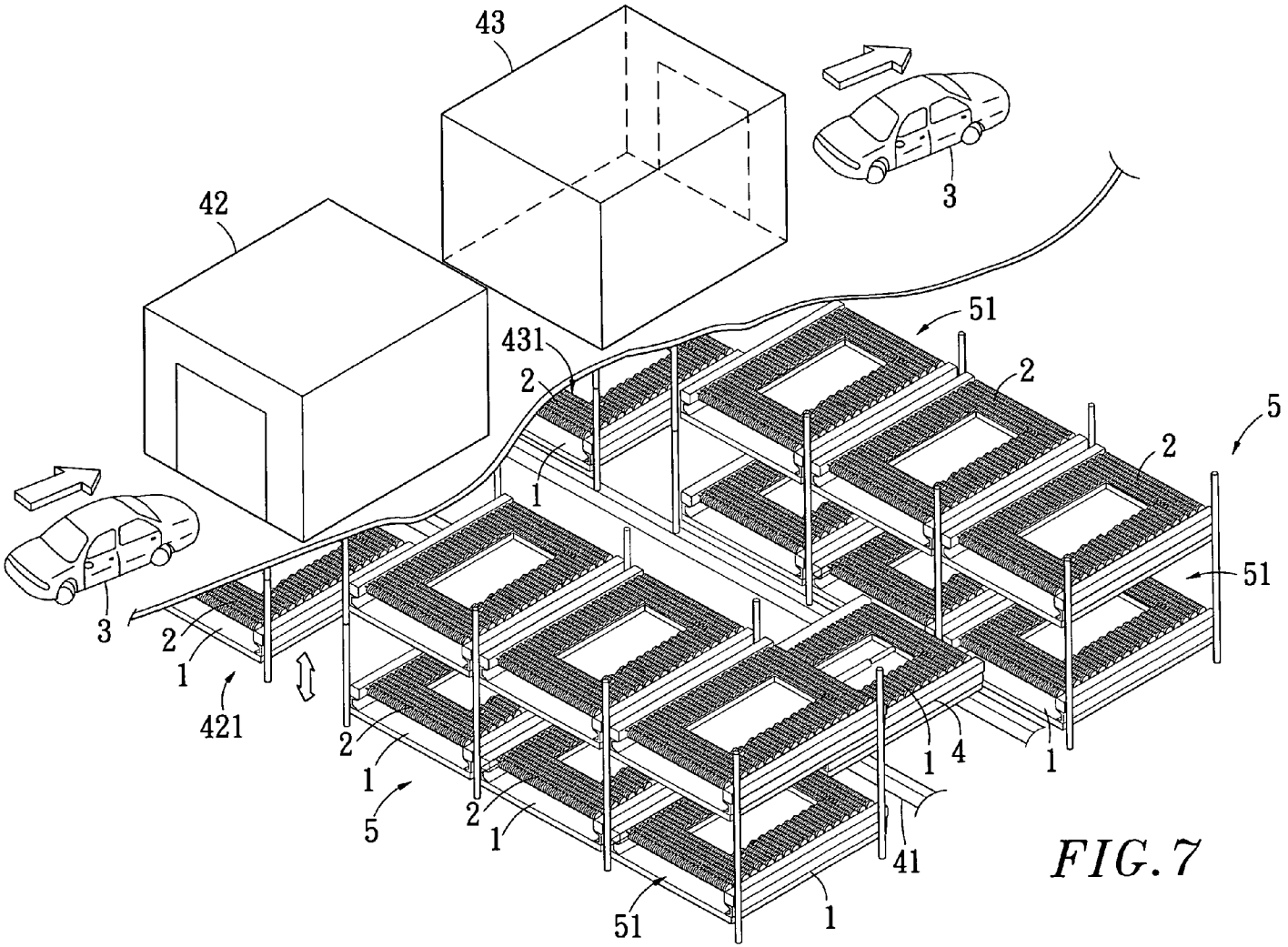
FIG. 7 is an elevation view of the parking device according to a preferred embodiment of the present invention.
Figure 8:
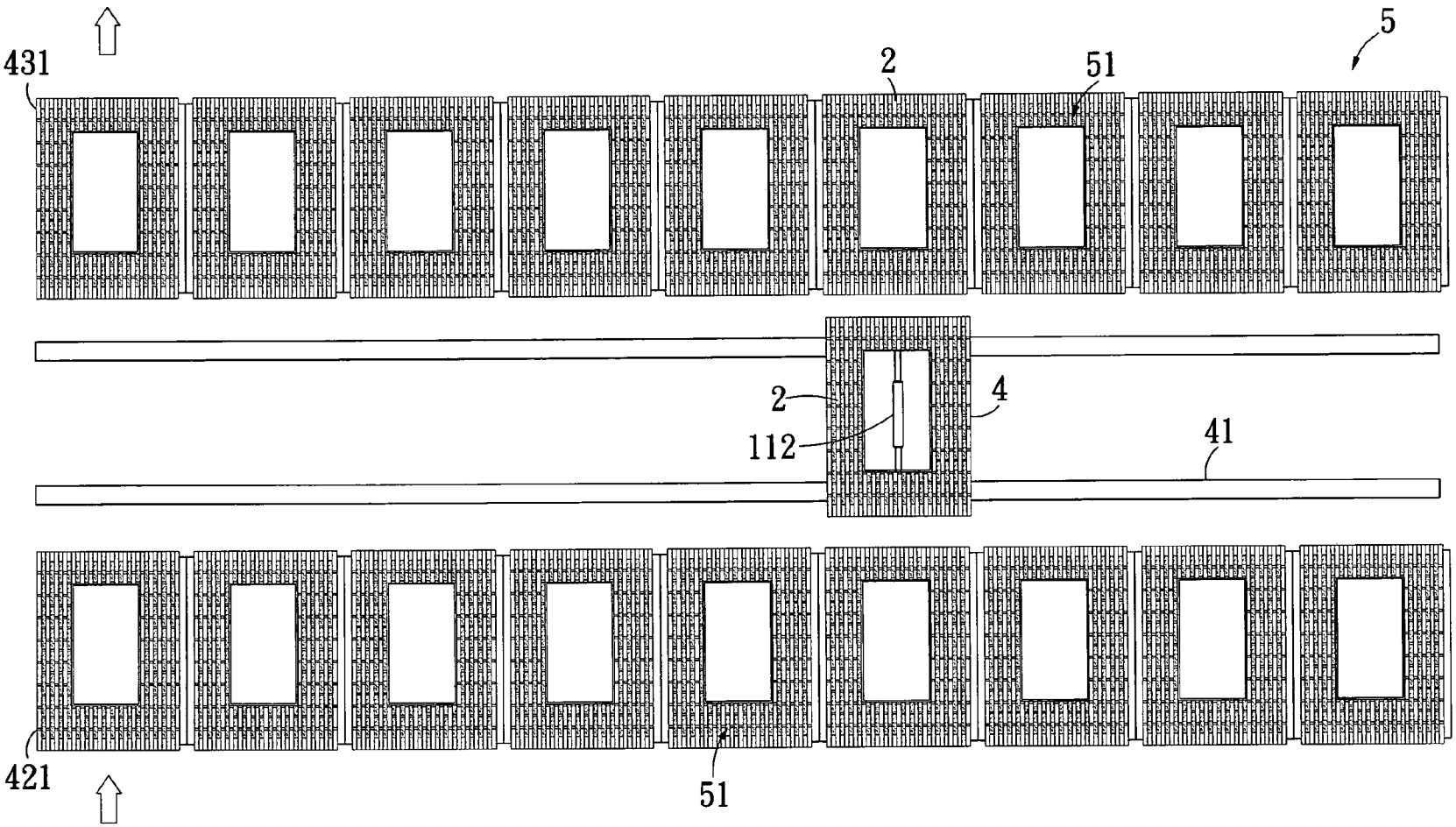
FIG. 8 is a top view of the parking device according to a preferred embodiment of the present invention.
Figure 9:
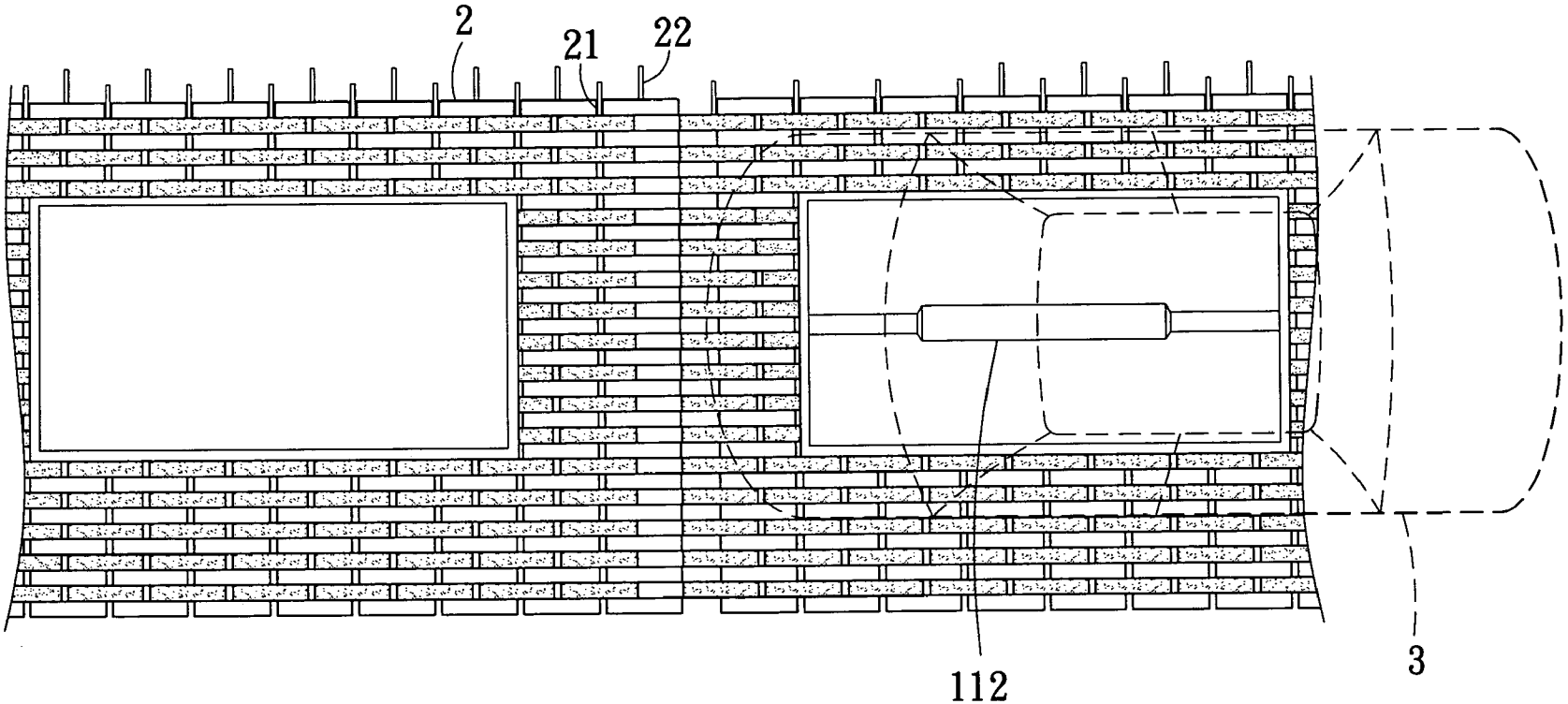
FIG. 9 is a top view of a plurality of transmission bodies according to an embodiment of the present invention.
Figure 10:
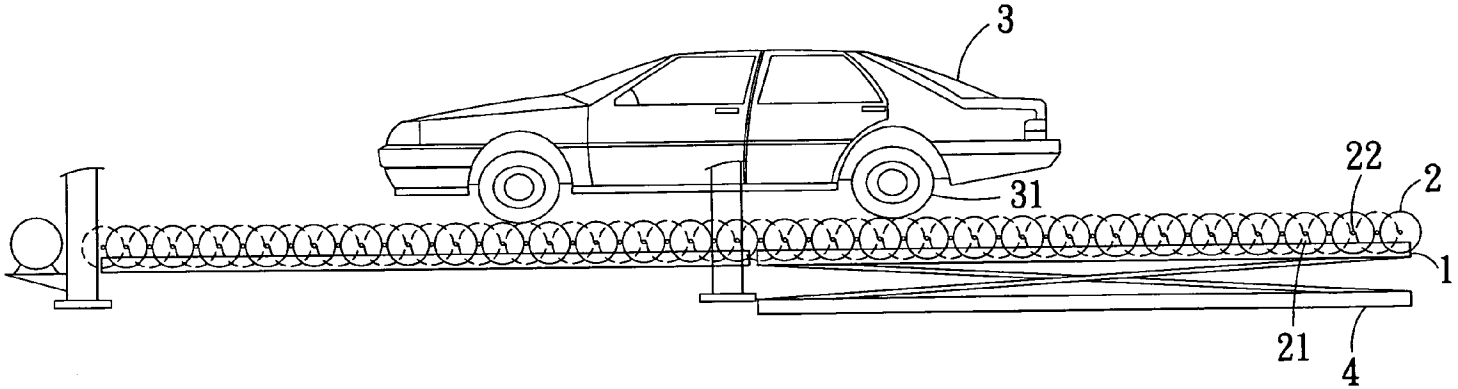
FIG. 10 is an exploded side view of the parking device according to another preferred embodiment of the present invention.
Figure 11:
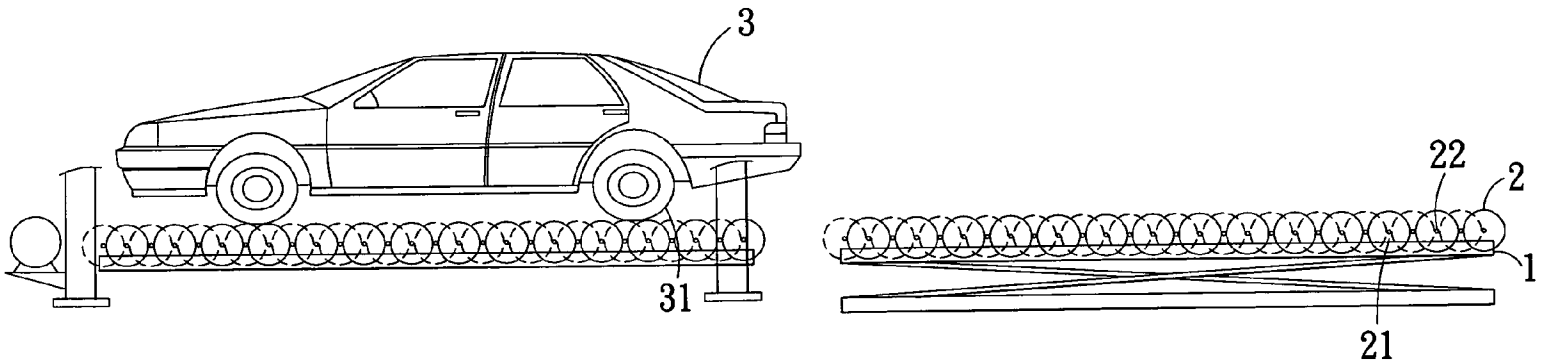
FIG. 11 is an exploded side view of the parking device according to another preferred embodiment of the present invention.

Referring to FIGS. 7 and 8, the trolley 1 of the parking device of the present invention can be applied in the warehouse parking lot, the multi-layer parking lot, the parking tower, the basement parking lot or the ground parking lot. The trolleys 1 may be set on a transportation deck 4 movable on a transport track 41 and space 51 of a parking tower 5 respectively. An entrance 42 and an exit 43 are provided on the transport track 41 at two distal ends for entry and exit of the car 3. The entrance 42 comprises a flat 421 and the exit 43 comprises a flat 431. The transmission bodies 2 on the transportation deck 4 can moves along the horizontal direction by the operation of the pushing liquid pressure tank 112, and the transmission bodies 2 on the space 51 and the flats 421 and 431 only roll without further horizontal movement. When the car 3 enters into the entrance 42 and stands on the flat 421, the flat 421 automatically moves the car 3 to the bottom. When the flat 421 sets the position to the transportation deck 4 on the transport track 41, the pushing liquid pressure tank 112 on the transportation deck 4 will drive the transmission bodies 2 thereof to joint to the transmission bodies 2 on the flat 421. Thus, the car 3 can be moved from the flat 421 to the transportation deck 4 and then moved further into the space 51 of the parking tower 5 to position the car 3 on the transmission bodies 2 of the space 51.

When the car 3 is on the way out of the parking tower 5, the transportation deck 4 sets the position to the space 51 first. Then, the pushing liquid pressure tank 112 on the transportation deck 4 will drive the transmission bodies 2 thereof to joint to the transmission bodies 2 on the space 51. Thus, the car 3 can be shifted to the transportation deck 4 from the space 51. Further, the car 3 on the transportation deck 4 moves along the transport track 41 to the exit 43 and the transportation deck 4 sets the position to the flat 431 of the exit 43. Then, the pushing liquid pressure tank 112 on the transportation deck 4 will drive the transmission bodies 2 thereof to joint to the transmission bodies on the flat 431 for shifting the car 3 to the flat 431. Accordingly, the car 3 can be shifted to the exit 43 from the flat 431. As long as the car 3 enters into the entrance 42 or the exit 43, the transmission bodies 2 on the transportation deck 4 is provided automatically to shift the car 3 in or out of the space 51 of the parking tower 5. Thus, the driver doesn't have to spend much time on waiting.

Referring to FIGS. 7, 8, 9, 10 and 11, the transmission bodies 2 of the trolley 1 on the transportation deck 4 move along the horizontal direction by the operation of the pushing liquid pressure tank 112, and the forked butt joints 23 of the transmission bodies 2 of the trolley 1 accordingly buckle to the forked butt joints 23 of the transmission bodies 2 on the space 51 or buckle to the forked butt joints 23 of the transmission bodies 2 of the flats 421 and 431. The drive unit 1222 of the trolley 1 further motivates the transmission bodies 2 to roll. Thus, the car 3 can be automatically shifted from the trolley 1 to the space 51 of the parking tower 5. Finally, the pushing liquid pressure tank 112 on the trolley 1 restores the shanks 122 and the transmission bodies 2 to the original position to detach the forked butt joints 23 of the transmission bodies 2 on the trolley 1 and the space 51.

Figure 12:
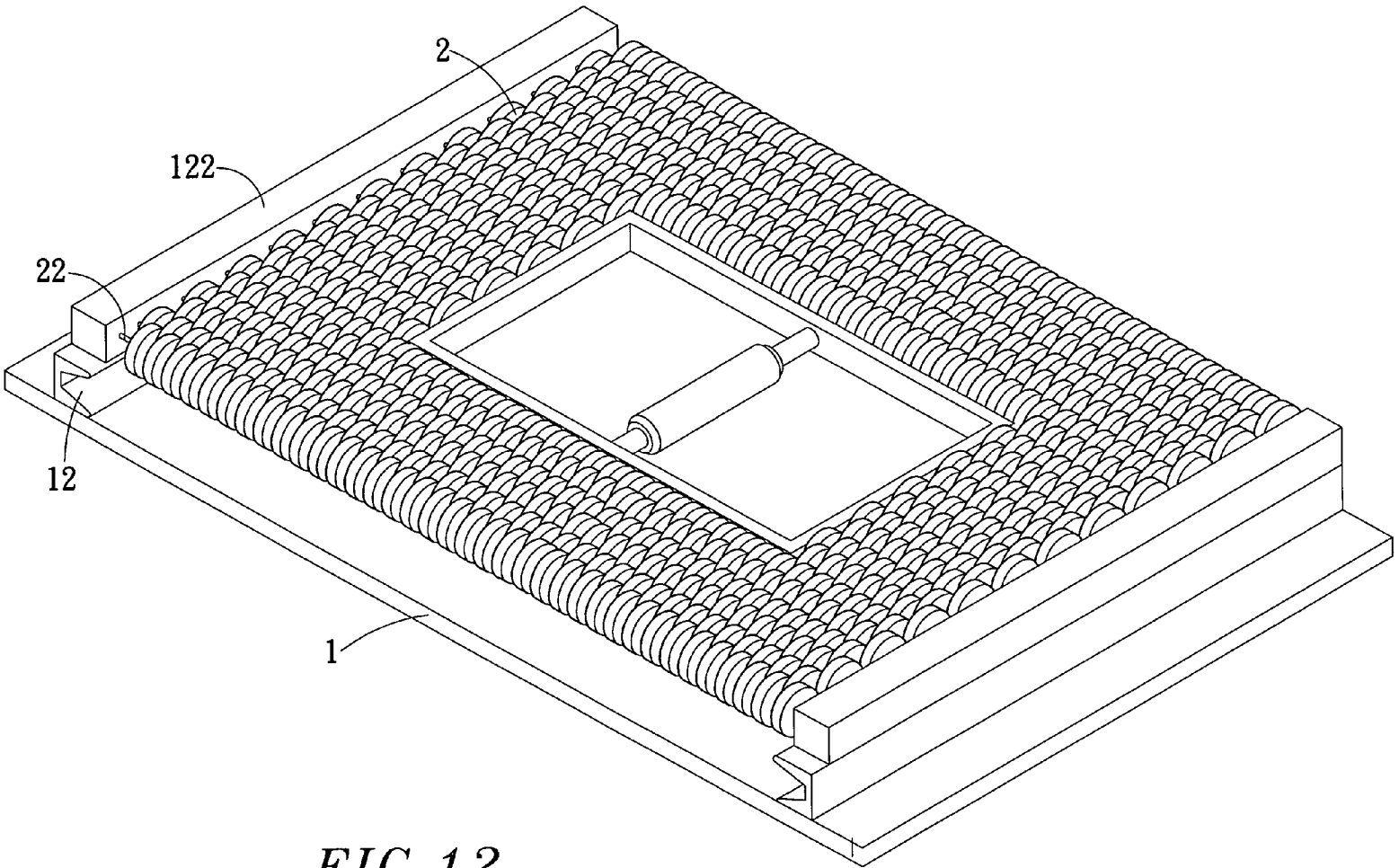
FIG. 12 is an elevation view of the parking device according to the other preferred embodiment of the present invention.
Figure 13:
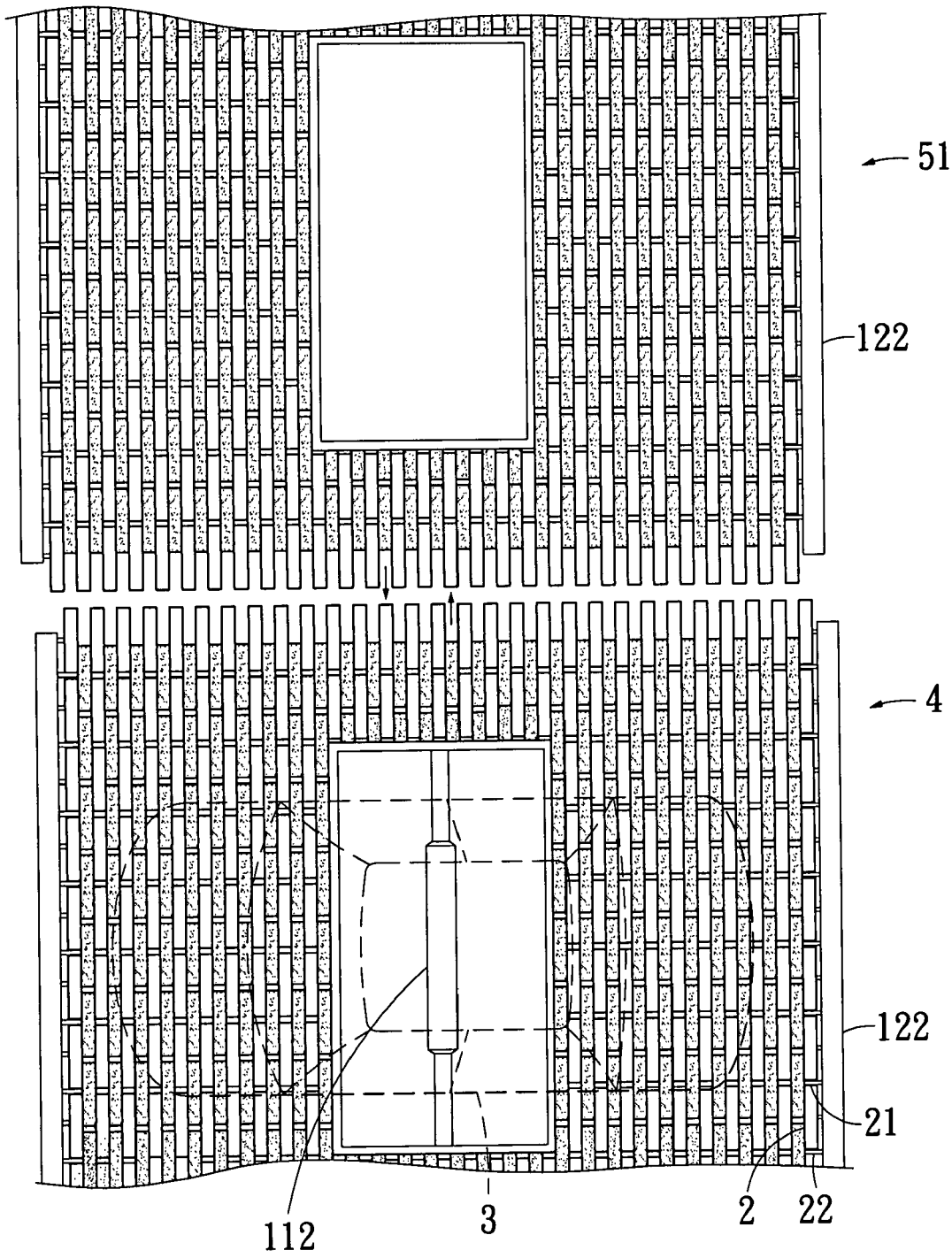
FIG. 13 is a top view of the parking device according to the other preferred embodiment of the present invention.

Referring to FIGS. 12 and 13, the array of the transmission bodies 2 on the trolley 1 may be along another direction to position the car 3 on the transmission bodies 2 of the transportation deck 4 from the side and to transport the car 3 to the transmission bodies 2 of the space 51. Thus, the transportation of the car 3 along another direction may be implemented. The trolley 1 of the present invention described above can be applied effectively in various types of parking lot.

The present invention has at least the following advantages.

1. The trolley comprises the alternate arrays of the transmission bodies to provide more stably transport.

2. The transportation deck can set the position to the space of the parking tower, and by buckling the forked butt joints of the transmission bodies, a gap between the transportation deck and the space may be minimized to avoid undesirably shaking the car.

3. The transmission bodies can transport the car stably, thus damage to the components caused during the quake may be effectively reduced.

4. The transmission bodies of the trolley can be driven by the drive unit to automatically transport the car to effectively reduce the operation time.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What the invention claimed is:

1. A parking device, suitable for minimizing shake to a car parked thereon during transporting, comprising:

a trolley, comprising two guide rails, two shanks positioned on outer sides of said guide rails and a drive unit; and a plurality of transmission bodies, arranged adjacently and alternately between inner sides of said shanks and strung as a plurality of arrays, comprising a plurality of shafts to couple said arrays to said shanks, and forked butt joints at two opposite sides of said transmission bodies in two ends.

2. The parking device according to claim 1, wherein said drive unit is set on said trolley.

3. The parking device according to claim 1, wherein said transmission bodies are arranged adjacently and alternately to fill a gap.

4. The parking device according to claim 2, wherein said transmission bodies are arranged adjacently and alternately to fill a gap.

* * * * *

UNITED STATES PATENT AND TRADEMARK OFFICE

CERTIFICATE OF CORRECTION

PATENT NO. : 7,819,612 B2
APPLICATION NO. : 11/662778
DATED : October 26, 2010
INVENTOR(S) : Kuo-Hsuen Huang It is certified that error appears in the above-identified patent and that said Letters Patent is hereby corrected as shown below:

On the title page, item (76),
Inventor should be amended to be: Kuo-Hsuen Huang

On the title page, item (86),
PCT No. should be amended to be: PCT/CN2005/001639

Signed and Sealed this
Twenty-ninth Day of March, 2011

David J. Kappos

David J. Kappos
*Director of the United States Patent and Trademark Office*